US006856241B1

(12) United States Patent
Tice et al.

(10) Patent No.: US 6,856,241 B1
(45) Date of Patent: Feb. 15, 2005

(54) VARIABLE CANDELA STROBE

(75) Inventors: Lee D. Tice, Bartlett, IL (US); Charles F. Fisler, Sycamore, IL (US); Simon Ha, Aurora, IL (US)

(73) Assignee: Honeywell International, Inc., Morristown, NJ (US)

( * ) Notice: Subject to any disclaimer, the term of this patent is extended or adjusted under 35 U.S.C. 154(b) by 74 days.

(21) Appl. No.: 10/429,900

(22) Filed: May 5, 2003

(51) Int. Cl.[7] ..... G08B 5/00

(52) U.S. Cl. ..... 340/331; 340/321; 396/164; 396/206

(58) Field of Search ..... 340/331, 293, 340/512, 509, 321; 315/241 P, 241 R, 241 S; 396/205, 164, 206

(56) References Cited

U.S. PATENT DOCUMENTS

| | | | | | |
|---|---|---|---|---|---|
| 4,618,803 | A | | 10/1986 | Hardy | 315/241 |
| 4,668,935 | A | | 5/1987 | McDermott | 340/332 |
| 4,684,852 | A | | 8/1987 | Balogh | 315/241 |
| 4,839,686 | A | | 6/1989 | Hosomizu et al. | 354/416 |
| 4,900,990 | A | * | 2/1990 | Sikora | 315/241 P |
| 4,951,081 | A | | 8/1990 | Hosomizu et al. | 354/415 |
| 5,249,007 | A | | 9/1993 | Tanaka | 354/145 |
| 5,313,247 | A | | 5/1994 | Hosomizu et al. | 354/415 |
| 5,523,654 | A | | 6/1996 | Sikora et al. | 315/241 |
| 5,570,077 | A | * | 10/1996 | Swieboda | 340/331 |
| 6,031,340 | A | * | 2/2000 | Brosius | 315/227 R |
| 6,243,001 | B1 | | 6/2001 | Kodaka | 340/326 |
| 6,278,382 | B1 | | 8/2001 | DeMarco et al. | 340/981 |
| 6,311,021 | B1 | | 10/2001 | Kosich | 396/164 |
| 6,411,201 | B1 | | 6/2002 | Hur et al. | 340/332 |
| 6,522,261 | B2 | | 2/2003 | Scheffler et al. | 340/815.73 |
| 6,661,337 | B2 | * | 12/2003 | Ha et al. | 340/293 |

OTHER PUBLICATIONS

Advertisement—Amseco—"Take a Closer Look at our Select–A–Strobe™ Family of Products", appearing in Security Dealer, May 2000,p. 74.

Data Sheet—Amseco Select–A–Horn/Strobe™ Combination—SHW24–153075, 4 pgs., May, 1999.

Edwards Systems Technology—EST Literature Sheet #85001–0549, 4 pgs. 2002.

EG&G Heimann Optoelectronics Flashtubes—Catalog—14 pgs., published more than a year prior to the filing date of the present application.

Wheelock Inc.—Series E. Single & Multi–Candela Speakers & Speaker Strobes, 2002, 4 pgs.

* cited by examiner

*Primary Examiner*—Anh V. La
(74) *Attorney, Agent, or Firm*—Welsh & Katz, Ltd.

(57) ABSTRACT

A selectable candela strobe alarm unit includes an energy storage circuit to reliably discharge a gas filled output device. The circuit includes a primary energy storage capacitor and a secondary energy storage capacitor. The capacitors can be configured in series or in parallel to produce a selected candela output from the gas filled output device.

24 Claims, 2 Drawing Sheets

VARIABLE CANDELA STROBE

FIELD OF THE INVENTION

The invention pertains to strobe devices of a type used in alarm systems. More particularly, the invention pertains to strobe devices with selectable candela outputs.

BACKGROUND OF THE INVENTION

Strobe devices require the application of a relatively high voltage across a flash tube in order to produce a gaseous discharge in the tube. In known devices, this high voltage is achieved by using a charge pump to transfer energy to an internal capacitor from an external energy source. The external source typically can be nominally 12 volts or 24 volts.

The capacitor is coupled in parallel with the flash tube and provides the energy for the flash. The amount of light from the flash tube is directly proportional to the energy stored in the capacitor that is discharged into the flash tube.

A single capacitor can be charged to various voltages in order to provide a multi-candela (multi-intensity) unit. However, there are limitations on the range of candela (intensity) that can be reliably achieved. One problem is that to flash the tube requires that the voltage across it be greater than a predetermined threshold amount (e.g. 180 volts) for reliable operation.

Present designs for multi-candela strobes include a range of 15 candela to 100 candela. To achieve such outputs, the capacitor needs to be charged to 240 volts for the 100 candela, but will only need to be charged to 120 volts for the 15 candela output. The 120 volts is, however, below the exemplary 180 volts needed for reliable operation.

In order to overcome this low voltage problem, known designs incorporate a voltage booster circuit to increase the voltage across the flash tube. One type of a voltage booster circuit is a voltage doubler circuit. One known voltage doubler design is disclosed in a "flashtubes" EG&G Heimann Optoelectronics Catalog, pg. 7, 1991. This document discloses a voltage doubler circuit to be used with a flash tube.

A prior art strobe unit with a known doubler is illustrated in FIG. 1. A capacitor C3 stores the energy that is going to determine the candela of the flash. It is coupled across a series combination of a flash tube LP1 and a diode Dl3.

Capacitor C13 is the doubler capacitor. It is charged through resistor RI 5 to the same voltage VC as capacitor C3 is charged. The polarities of the voltages on the capacitors C3 and Cl3 are the same. Capacitor C4 is used for the trigger function and is charged to the same voltage and polarity as is capacitor Cl3.

When the unit is triggered, by a signal from the trigger circuit, SCR Q8 will conduct and pull node A low. This causes C4 to discharge through Q8 and the primary winding of TR2, the trigger transformer.

Until the flash tube is triggered by the voltage out of the secondary winding of Tr2, C13 and C3 cannot discharge. However, the voltage across the flash tube at this time is double the voltage VC of C3 (far exceeding the minimum required voltage). When the tube flashes, it first discharges capacitor C13, then capacitor C3. The energy stored in capacitor C3 provides the preselected candela output from tube LP1.

While known devices provide a selectable candela output, the use of a voltage doubler does have some disadvantages.

At high output intensities, the voltage across the tube LPI is substantially equal to 2VC which can be quite high. This high voltage requires the use of components rated therefore. In addition, in compact units with the circuitry implemented on a printed circuit board, arcing is a potentially problem.

There thus continues to be a need for multi-candela strobe units which provide reliable, triggerable light of a selected intensity. Preferably such reliability could be achieved in compact, high density packaging, without the necessity of high voltage components. It would also be preferable if operational reliability could be achieved while simultaneously eliminating arcing during normal operation.

DETAILED DESCRIPTION OF THE EMBODIMENTS

Figure 1:
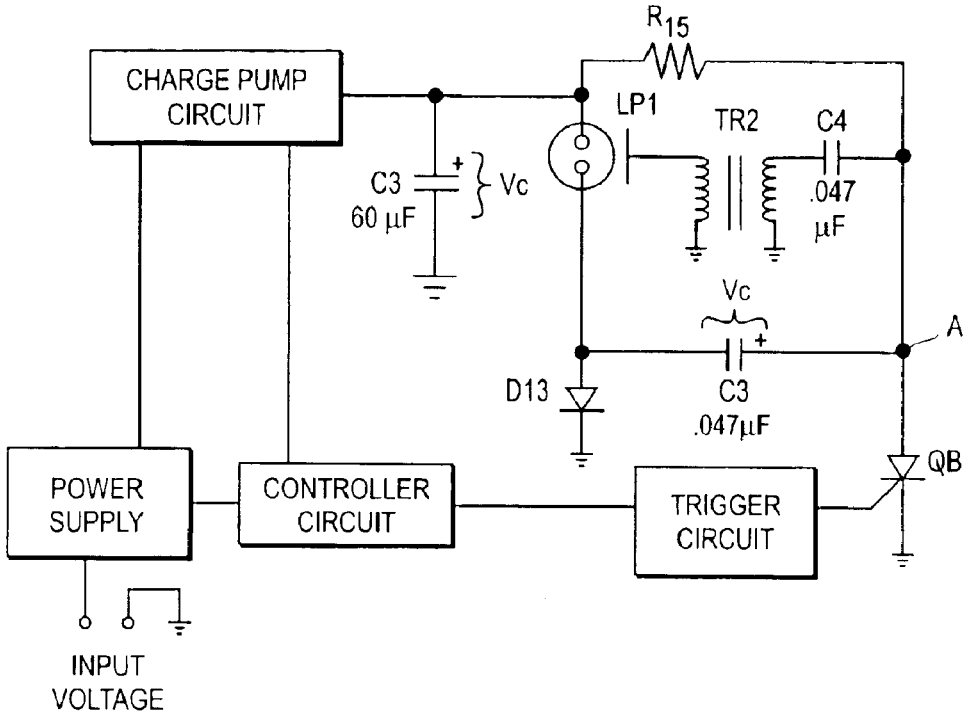
FIG. 1 PRIOR ART
FIG. 1 is a schematic diagram of a prior art strobe alarm.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

The disadvantages of the prior art above can be overcome with a power supply in accordance with the invention. A more controlled voltage is achieved across the flash tube using a voltage booster circuit that is not a "doubler" but rather an "adder" type circuit. The present circuit operates significantly differently than the prior art circuits.

Figure 2A:
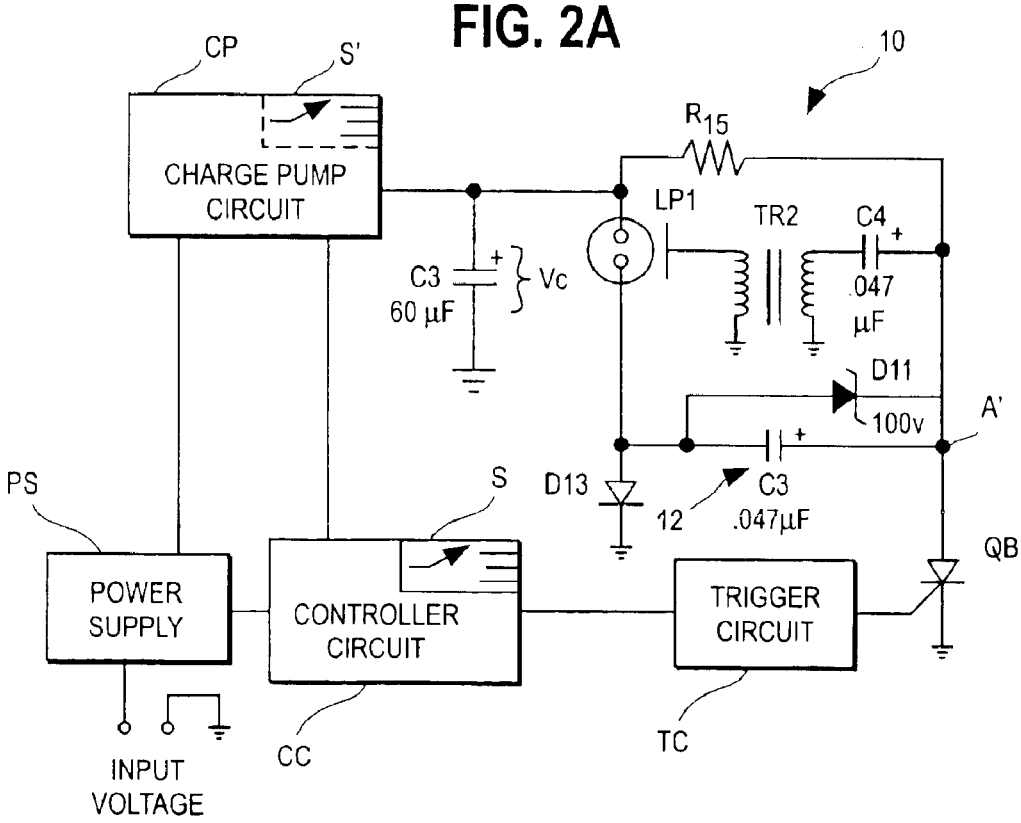
FIG. 2A is a schematic diagram of a first embodiment of the invention.
Figure 2B:
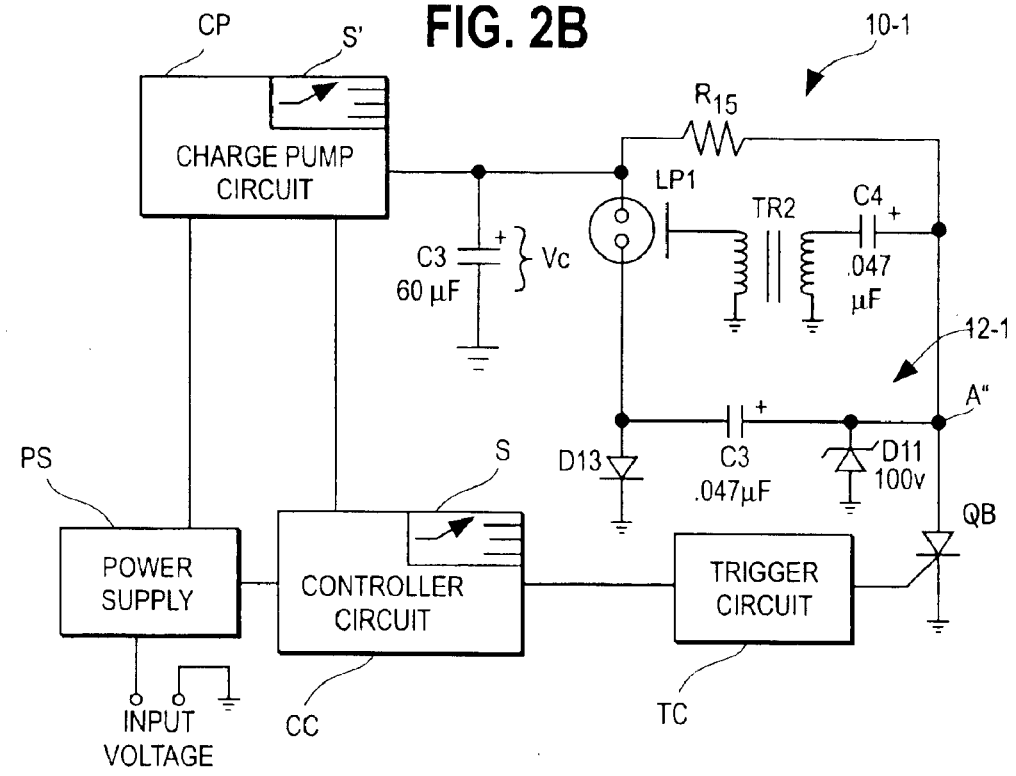
FIG. 2B is a schematic diagram of a second embodiment of the invention.

FIGS. 2A, 2B illustrate two different embodiments 10, 10-1 of strobe alarms in accordance with the invention. In both FIGS. 2A, 2B the maximum voltage capable of being applied across tube LP12 is the sum of VC, the voltage across capacitor C3 plus the voltage across an off-set circuit 12, FIG. 2A or 12-1, FIG. 2B. This total voltage, as discussed below, will be substantially less than 2VC but great enough to produce reliable, repeatable flashing of tube LP1.

In FIG. 2A, a power supply PS provides energy for circuit 10, from a remote source. Supply PS is coupled to controller CC, and charge pump circuit CP as well as other circuitry as would be known to those of skill in the art. The output of charge pump CP couples energy to capacitor C3 and other components of circuit 10 as discussed subsequently. Trigger circuit IC provides trigger gate signals to SCR Q8.

Candela selecting switches S or S' can be coupled to either controller CC or charge pump CP without limitation. Switch settings can be established manually, electronically or both without limitation.

In FIG. 2A, an off-set circuit 12 includes a Zener diode D11 which is coupled, in parallel, with the capacitor C13. Diode D11 causes the voltage of node A', Q8, C4', and C13' to be clamped to a known, predetermined voltage (e.g. 100 volts). This voltage is limited by the off-set circuit 12, for example by the voltage across D11. It will not vary with the different charging voltages of C3 used to obtain the different candela rating. Alternate sources, such as a power supply could be used instead of capacitor C13 without limitation.

When the capacitors have been changed, the voltage across the flash tube is VFT=VC+VD 11. The addition of the diode D11 limits the voltage variations across tube LP1. It is possible to control the total voltage across the flash tube LP1 to tighter limits than is achieved by a prior art voltage doubler The tighter voltage range is demonstrated in Table 1 which compares a voltage limiter as in FIG. 2A to a doubler, as in FIG. 1.

In the embodiment of FIG. 2A, the flash tube LP1 requires 180 volts minimum to flash reliably. Table 1 illustrates that both the circuits of FIG. 1 and FIG. 2A create voltages greater than 180 volts to satisfy this requirement. However, at the highest candela rating, the circuit of FIG. 2A applies 140 volts less to tube LP1 than does the circuit of FIG. 1. This is a significant difference.

The limiter circuit 12 couples a smaller range of voltages across the flash tube LP1 while operating from 15 candela to 100 candela than do the prior art doubler-circuits. The lower over-all voltage translates to reduced breakdown voltage specifications for the various components (less expensive) and possibly to a more compact spacing, higher density of circuit board points, without arcing, than is the case with the voltage doubler configuration of FIG. 1.

It will be understood that the specific minimum threshold voltage to flash the tube LP1 reliably may vary as a result of tube geometry, gas and the like without limitation. Such variations come within the spirit and scope of the invention.

TABLE 1

| Candela Rating | Voltage With Limiter 12 | Voltage With Doubler |
|---|---|---|
| 15 | 220 | 240 |
| 30 | 240 | 280 |
| 110 | 340 | 480 |

Table 1 illustrates that the voltage across the flash tube varies less across a range of different candela outputs with the limiter circuit 12 than in the prior art. Both capacitor values and the value of the constant voltage used in the limiter circuit of FIG. 2A can be changed to different values without departing from the scope of this invention.

FIG. 2B illustrates an alternate embodiment 10-1. Components common to those in FIG. 2A have been designated with the same identification numerals. In FIG. 2B, a limiting circuit 12-1 includes capacitor C13 and Zener diode D11, between node A" and ground. Circuit 12-1 limits the total voltage across LP1 prior to a trigger event. In circuit 12-1, current through Zener D11 advantageously does not flow through diode D13.

Figure 3:
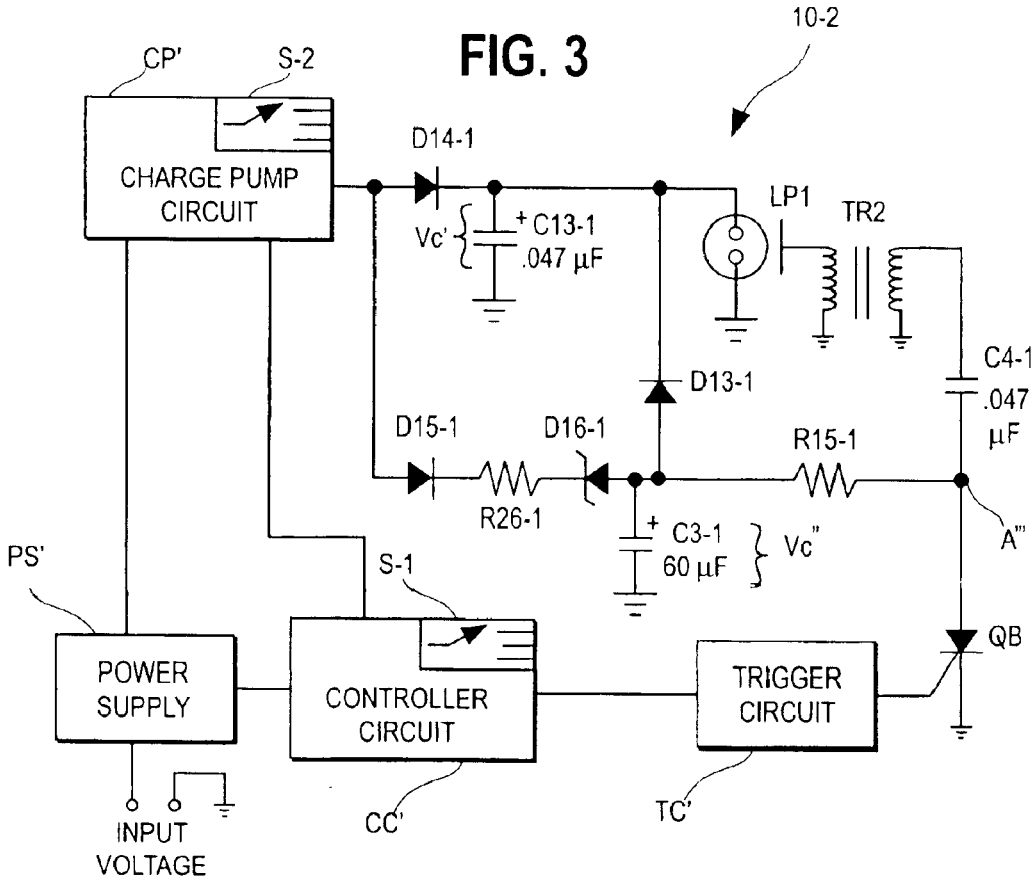
FIG. 3 is a schematic of another embodiment of the invention.

The voltage across the flash tube LP1 can also be established by the use of a non-booster type circuit design. In this embodiment, two capacitors are still used. They are coupled in parallel, not in series with the flash tube as in the prior art. FIG. 3 illustrates an embodiment 10-2 in accordance with this configuration.

In the embodiment of FIG. 3, circuit 10-2 incorporates power supply PS' which receives electrical energy from an outside source and couples same to a controller circuit CC' as well as a charge pump circuit PC' and other components of circuit 10-2 as would be understood by those of skill in the art. Controller circuit CC' is coupled to trigger circuit TC' whose output provides gate drive voltage to SCR Q8. The output from the charge pump circuit CP' is available to couple energy to capacitors in circuit 10-2 including capacitor C3-1, C4-1 and Cl 3-1 as discussed below.

In circuit 10-2, capacitor C13-1 will be charged, via charge pump circuit CP', through diode D14-1. This establishes a voltage across the ionizationable output device LP1 having a value VC'.

Capacitor C3-1 is charged to a voltage VC" by the charge pump circuit CP' through diode D15-1, resistor R26-1 and Zener diode D16-1. The voltage VC" will be less than the voltage across capacitor C13-1 when both capacitors are fully charged. In this condition, diode D13-1 is reversed biased.

In the circuit 10-2, the capacitor C4-1 is charged to substantially the same voltage as is capacitor C3-1. Capacitor C4-1 provides triggering energy via transformer TR2 to the trigger electrode of the gas filled tube LP1.

When the capacitors C3-1, C4-1 and C13-1 are fully charged, control circuit CC' can initiate a flash or an optical output by causing trigger circuit TC' to trigger SCR Q8. This causes the voltage at the anode of SCR Q8, node A'" to drop to a voltage close to ground, the anode-cathode voltage of Q8, which in turn couples a pulse via transformer TR2 to trigger the gas filled tube LP1. Capacitor C13-1, which has been charged to the higher voltage VC', will discharge first through the anode/cathode of tube LP 1. This will in turn cause initial ignition, ionization, in the gas filled tube LPI which in turn will continue to discharge capacitor C13-11.

When diode D13-1 becomes forward biased, capacitor C3-1, with a value that is much larger than capacitor C13-1, will discharge through tube LP1.

The amount of energy required to initiate ionization and to start the tube LP1 to flash is relatively small compared to the amount of energy needed for the selected candela output. As a result, capacitor C3-1, which is substantially larger than capacitor C13-1 provides the primary stored energy for producing the desired level of illumination from the gas tube LP1.

When capacitor C3-1 has discharged, ignition ceases. Charge pump circuit CP' is then able to recharge the capacitors of circuit 10-2 for the next optical output cycle.

The selected intensity or candela output level can be selected in circuit 10-2 using switches S-1 or S-2 coupled respectively to controller circuit CC'or charge pump circuit CP', all without limitation. Such switches can be manually or electronically settable.

In summary, the embodiments 10, 10–1 and 10-2 all illustrate driving circuits which provide alternates to voltage doubler circuitry for purposes of generating selectable candela output levels in a strobe alarm. In all instances, a voltage substantially less than twice the voltage on the major illumination providing storage element is added to that voltage to initiate ignition of an ionization gas discharge tube. Subsequently, the energy stored in the primary storage capacitor is used to provide the selected candela output level for the circuit.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An alarm strobe comprising:

a housing:

a device to select an output light level, the device is carried by the housing;

a gas filled output element carried by the housing;

a power supply, coupled to the device and the output element, the supply provides sufficient energy, in response to a triggering event, to initiate a discharge of the output element and produce the selected output light level, the supply has a capacitor and a voltage limiting circuit, the capacitor and circuit are coupled in series with the output element in response to the triggering event.

2. A strobe as in claim 1 where the circuit includes an energy storage element configured to exhibit a voltage which is a fraction of a voltage across the capacitor prior to the triggering event.

3. A strobe as in claim 1 where the circuit includes a second capacitor configured to exhibit a voltage which is a fraction of a voltage across the capacitor prior to the triggering event.

4. A strobe as in claim 3 where the circuit includes at least one diode.

5. A strobe as in claim 4 where the second capacitor and the diode have a common node.

6. A strobe as in claim 5 where the second capacitor and the diode are coupled in parallel at least for a time interval subsequent to the triggering event.

7. A strobe as in claim 6 where the second capacitor and the diode establish a limiting voltage which during at least part of the time interval has a polarity which is additive to the voltage across the capacitor.

8. A strobe as in claim 6 where the diode comprises a Zener diode.

9. A strobe as in claim 1 where the voltage limiting circuit limits total voltage across the output element to be less than 1.9 times the voltage across the capacitor prior to a triggering event.

10. A method of generating a variable intensity visible alarm indicating output comprising:

establishing a selection indicium indicative of a selected output intensity;

establishing first and second energy sources where one source exhibits a voltage which is a fraction of a second voltage exhibited by the other source;

providing a triggering indicium;

using both sources with the voltages in one of series or parallel to produce an initial discharge and then subsequent illumination in accordance with the selection indicium.

11. A method as in claim 10 which includes beginning to discharge one of the energy sources before the other.

12. A method as in claim 10 which includes limiting the voltage of the sources so as to substantially eliminate high voltage arcing.

13. A method as in claim 10 which includes providing first and second capacitors in the respective energy sources to store respective amounts of energy.

14. A method as in claim 13 which includes configuring the capacitors in parallel for at least a selected time interval during the discharge.

15. A method as in claim 13 which includes configuring the capacitors in series for at least a selected time interval during the discharge.

16. A method as in claim 10 where the selection indicium is manually settable.

17. A strobe comprising:

an optical output device;

a selector element for selection of an optical output;

a control circuit which includes charging circuitry, the control circuit is coupled to the selector element and the output device;

first and second energy storage circuits, coupled to the control circuit, with one storage circuit exhibiting additional energy at a voltage not present at the other storage circuit, the control circuit coupling the energy storage circuits in one of a parallel and a series configuration to the optical output device to product the selected optical output.

18. A strobe as in claim 17 which includes in one storage circuit a capacitor having a value more than one hundred times greater than a capacitor in the other storage circuit.

19. A strobe as in claim 17 where a maximum voltage present across any pair of component leads is less than twice a maximum capacitor charging voltage and is inadequate to produce arcing for a selected component density.

20. A strobe alarm unit comprising:

a housing;

a gas filled output member carried by the housing;

an output selector carried on the housing;

first and second energy storage elements coupled at least during selected time intervals to the output member and an isolating element coupled between the elements with one element facilitating a discharge in the member, in response to a trigger event with the other element initially isolated therefrom and with the other element subsequently coupled thereto to facilitate a discharge in the member in accordance with the output selector.

21. A strobe unit as in claim 20 where the isolating element comprises a semiconductor switch.

22. A strobe unit as in claim 21 where the switch has one of two terminals or three terminals.

23. A strobe unit as in claim 20 with one capacitor charged to a voltage which is a fraction of a voltage to which the other capacitor is charged.

24. A strobe unit as in claim 20 with one capacitor changed to a that exceeds a voltage to which the other capacitor is charged by a fraction.

* * * * *